US005595317A

United States Patent [19]

Hodge

[11] Patent Number: 5,595,317

[45] Date of Patent: Jan. 21, 1997

[54] LID PROP FOR COMMERCIAL TRASH BIN

[76] Inventor: Tony Hodge, 6504 Eldridge St., San Diego, Calif. 92120

[21] Appl. No.: 459,754

[22] Filed: Jun. 2, 1995

[51] Int. Cl.[6] ..... B65D 43/24

[52] U.S. Cl. ..... 220/335; 220/744; 220/379; 16/250; 16/265; 248/213.1; 248/214

[58] Field of Search ..... 220/335, 379, 220/744, 906; 16/250–254, 260–263, 265, 267; 248/202.1, 213.1, 213.2, 214, 907

[56] References Cited

U.S. PATENT DOCUMENTS

| | | | |
|---|---|---|---|
| Re. 29,494 | 12/1977 | Hodge | 220/334 |
| Re. 30,890 | 3/1982 | Hodge | 220/331 |
| 259,318 | 6/1882 | Kirk | 16/252 |
| 369,113 | 8/1887 | King, Jr. | 220/744 X |
| 498,020 | 5/1893 | Murray | 220/379 |
| 498,569 | 5/1893 | Peterson | 220/744 X |
| 1,395,554 | 11/1921 | Brown | 220/335 |
| 1,476,966 | 12/1923 | Hachmann | 16/252 |
| 2,541,604 | 2/1951 | Normandin | 220/744 |
| 2,622,761 | 12/1952 | Linde | 220/32 |
| 2,730,253 | 1/1956 | Oswalt | 214/304 |
| 3,137,408 | 6/1964 | Taylor | 220/35 |
| 3,687,317 | 8/1972 | Gagel | 214/304 |
| 3,951,302 | 4/1976 | Owen | 220/331 |
| 3,989,162 | 11/1976 | Hodge et al. | 220/331 |
| 4,014,457 | 3/1977 | Hodge | 220/331 |
| 4,098,429 | 7/1978 | Hodge | 220/331 |
| 4,148,411 | 4/1979 | Hodge et al. | 220/331 |
| 4,182,530 | 1/1980 | Hodge | 294/73 |
| 4,186,844 | 2/1980 | Swanson | 220/333 |
| 4,375,711 | 3/1983 | Franzen et al. | 220/744 X |
| 4,773,555 | 9/1988 | Merino | 220/379 X |
| 5,085,341 | 2/1992 | Hodge | 220/331 |

FOREIGN PATENT DOCUMENTS

| | | | |
|---|---|---|---|
| 503059 | 7/1930 | Germany | 220/744 |
| 506187 | 5/1939 | United Kingdom | 220/744 |

*Primary Examiner*—Gary E. Elkins
*Assistant Examiner*—Nathan Newhouse
*Attorney, Agent, or Firm*—Brown, Martin, Haller & McClain

[57] ABSTRACT

A prop for propping the lid of a trash bin in a partially open position includes a frame having an elongated slot. The prop is mounted on a trash bin by inserting the lid hinge rod of the bin through the slot. When mounted on a trash bin, the prop can be moved in a direction perpendicular to the axis of the lid hinge rod, the rod sliding laterally in the slot. The prop can thus be moved between a position in which it supports the lid in a partially open position and a position in which the lid can be swung fully open. When the prop is in the former position, two arms, one or both of which may be integral to the frame, extend generally perpendicularly away from the axis of the hinge rod. In this position, one arm contacts the rear wall of the bin and the other contacts the lid of the bin. When the prop is moved to the other position, one of the arms disengages the portion of the bin with which it was it contact. The lid can then be freely swung to any position.

10 Claims, 2 Drawing Sheets

LID PROP FOR COMMERCIAL TRASH BIN

BACKGROUND OF THE INVENTION

The present invention relates generally to commercial trash bins and, more specifically, to a device for propping the lids of such bins in an open position.

Trash bins used by commercial establishments have one or more hinged lids that can be opened to deposit trash into the bin. The bins are designed to be emptied by a trash truck. A hydraulically operated lift on the truck engages the trash bin using two forks, lifts it above the truck, and inverts the bin. The lids swing open, and the contents of the bin fall into the truck.

The lids of conventional trash bins are mounted on hinges at the rear wall of the bin adjacent the rim of the bin. When the lids are closed, they are oriented generally horizontally and perpendicular to the side walls of the trash bin. The lids can be swung open approximately 270 degrees to an orientation in which they are generally parallel to the rear wall of the trash bin. After a user has opened a lid in this manner and deposited the trash, the opened lid is out of the user's reach, and the user therefore must walk to the rear of the trash bin to close the lid. A user can avoid this inconvenience by holding on to the lid with one hand while depositing trash with the other hand, but this procedure is also inconvenient because a user may desire to use both hands to deposit the trash.

Practitioners in the art have developed devices to prop the lid of a trash bin partially open to facilitate depositing trash. A prop has been used that consists of a bar mounted at a proximal end to an inner side wall of the bin with a rotatable connection. The distal end of the bar can be pivoted upwardly to a position in which it supports the lid in a partially open position at about a 30–45 degree angle with the rim of the bin. U.S. Pat. No. 4,186,844, issued to Swanson, and U.S. Pat. No. 5,085,341, issued to Hodge, each discloses a trash bin having a lid mounted to it using hinges that pivot or rotate on two parallel axes. When the lid is opened from the closed position to a partially open position, the lid rotates about the first axis but not the second. A limit bar rotates into contact with the rear wall of the trash bin when the lid reaches the partially open position at about a 30–45 degree angle with the bin rim, thereby allowing the lid to rest in that position. The lid may be further opened by rotating it about the second axis (but not the first axis because the limit bar prevents such rotation). The lid may thus be opened to the fully open position in which it is generally parallel to the rear wall of the trash bin.

Large trash items cannot easily be deposited in the trash bins described in the above-referenced patents when the lids are in the partially open position. It would be desirable to prop the lid partially open at an angle substantially greater than 45 degrees. It would also be desirable to provide an economical lid prop that can be retrofitted on existing trash bins of conventional design without modifying the bin. These problems and deficiencies are clearly felt in the art and are solved by the present invention in the manner described below.

SUMMARY OF THE INVENTION

The present invention is an economical prop for propping the lid of a trash bin in a partially open position. The prop comprises a frame having an elongated slot. The prop is mounted on a trash bin by inserting the lid hinge rod of the bin through the slot. When mounted on a trash bin, the prop can be moved in a direction perpendicular to the axis of the lid hinge rod, the rod sliding laterally in the slot. The prop can thus be moved between a position in which it supports the lid in a partially open position and a position in which the lid can be swung fully open. When the prop is in the former position, two arms, one or both of which may be integral to the frame, extend generally perpendicularly away from the axis of the hinge rod. In this position, one arm contacts the rear wall of the bin and the other contacts the lid of the bin. When the prop is moved to the other position, one of the arms disengages the portion of the bin with which it was it contact. The lid can then be freely swung to any position.

The foregoing, together with other features and advantages of the present invention, will become more apparent when referring to the following specification, claims, and accompanying drawings.

BRIEF DESCRIPTION OF THE DRAWINGS

For a more complete understanding of the present invention, reference is now made to the following detailed description of the embodiments illustrated in the accompanying drawings, wherein.

DESCRIPTION OF A PREFERRED EMBODIMENT

Figure 1:
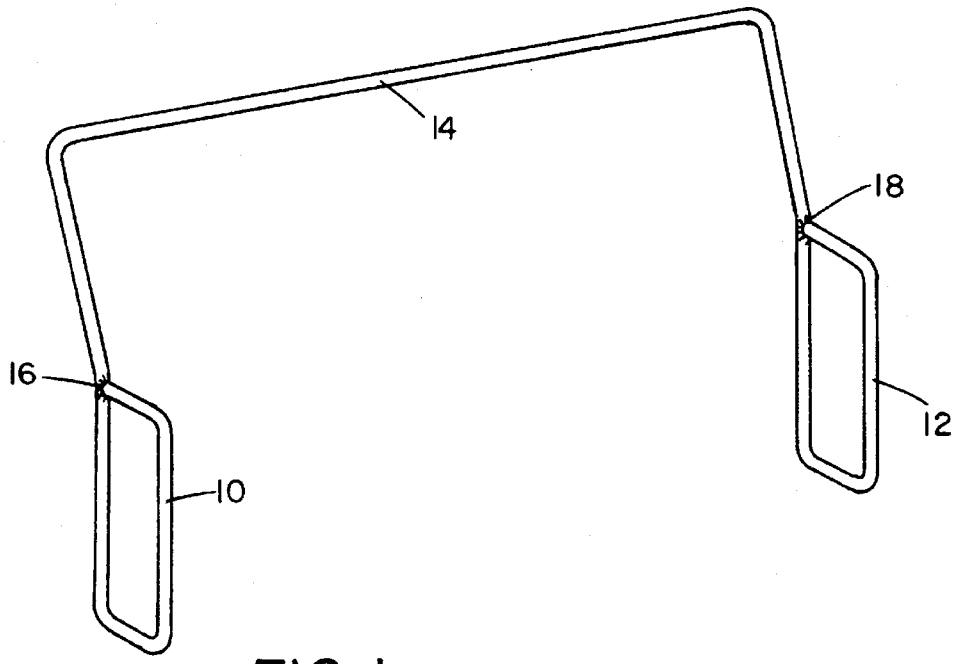
FIG. 1 is a perspective view of a trash bin lid prop.

As illustrated in FIG. 1, a lid prop has two elongated rectangular frame members 10 and 12, which together define a frame. A "U"-shaped arm 14 extends away from frame members 10 and 12. The longer sides of frame members 10 and 12 are preferably offset from the plane in which arm 14 generally lies by an angle between approximately 10 and 60 degrees. The elongated sides of frame members 10 and 12 define a second arm that extends away from arm 14. The lid prop may be made by bending a metal rod and welding the ends of the rod in place at points 16 and 18.

Figure 2:
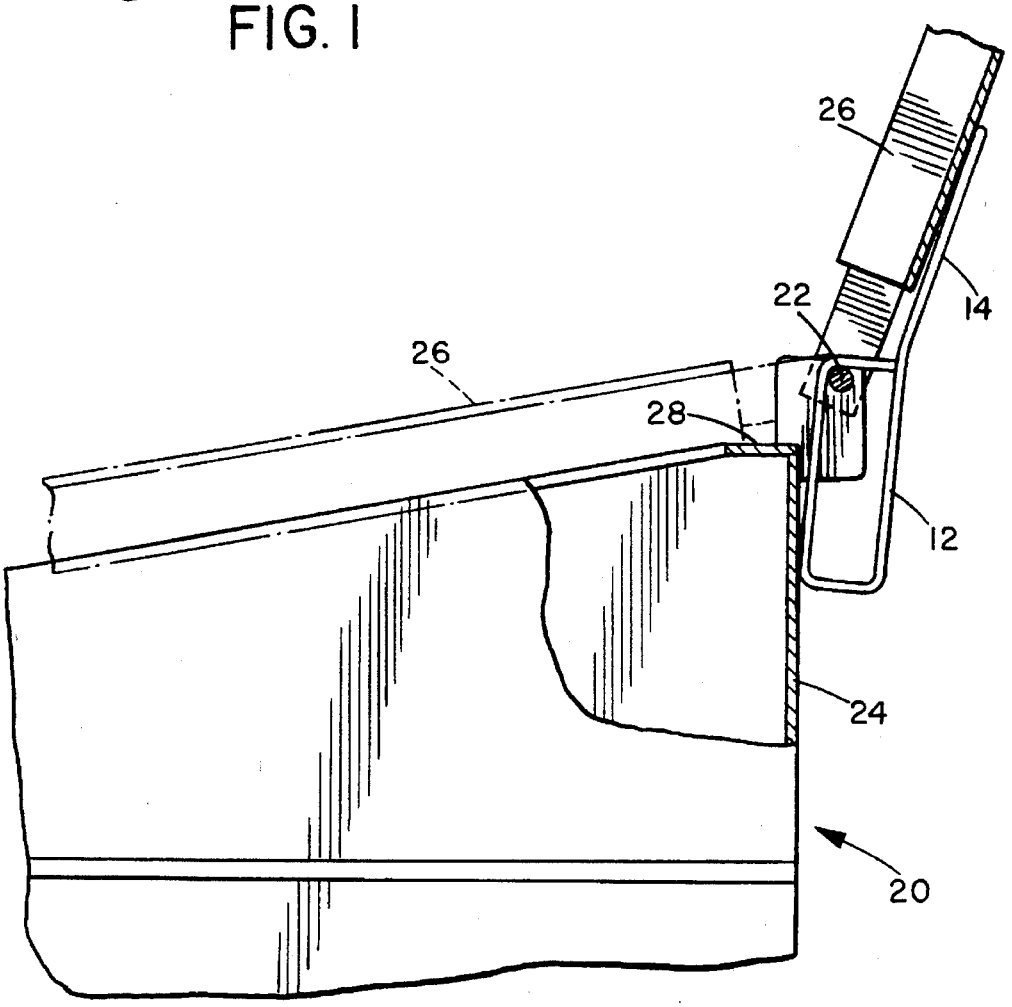
FIG. 2 is a side elevation view, partially cut away, of a portion of a trash bin with the lid prop mounted on it.
Figure 3:
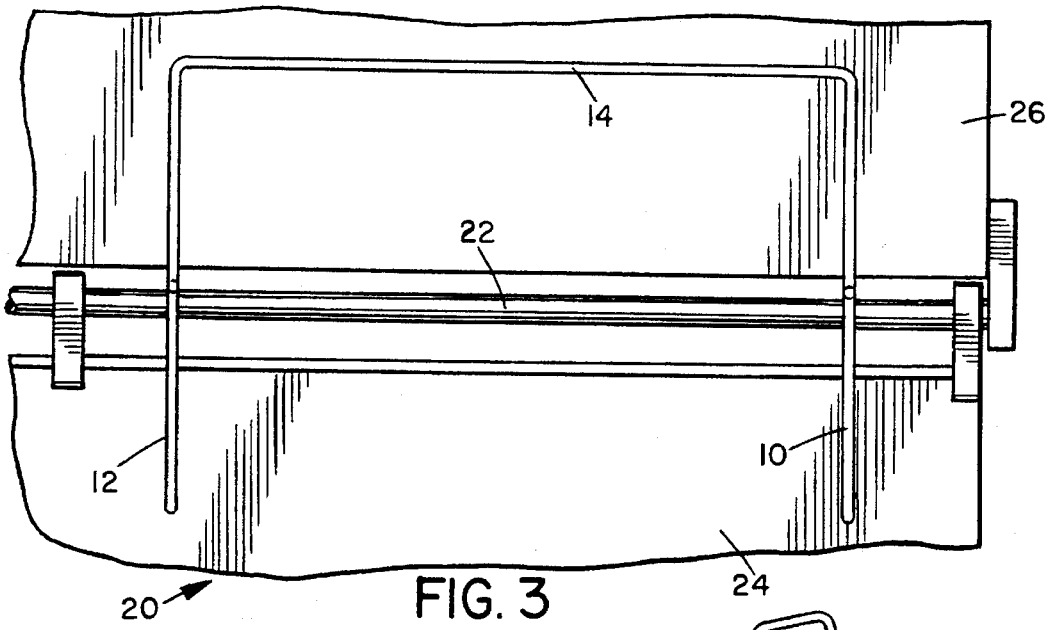
FIG. 3 is a rear view of the structure of FIG. 2.

To use the prop, it is mounted on a commercial trash bin 20. The lid hinge 22 of the trash bin is received through the openings in frame members 10 and 12, as illustrated in FIGS. 2–3. Frame members 10 and 12 have an elongated rectangular shape and together define a slot-like passage for receiving lid hinge 22. The prop can thus be moved laterally with respect to lid hinge 22, lid hinge 22 sliding in the slot-like passage in the direction of the longer dimension of frame members 10 and 12.

When the prop is oriented in the position shown in FIGS. 2–3, the second arm, which comprises the elongated sides of frame members 10 and 12, contacts the rear wall 24 of trash bin 20. The lid 26 of trash bin 20 can be swung open from the closed position, shown in FIG. 2 in phantom line, to the partially open position shown in solid line. In this partially open position, lid 26 bears against arm 14, which in turn, bears against rear wall 24. The portions of frame members 10 and 12 that extend away from hinge rod 22 in this position thus together function as a second arm. This arm and arm 14 thus pivotally support lid 26 with respect to rear wall 24 about hinge rod 22.

Figure 4:
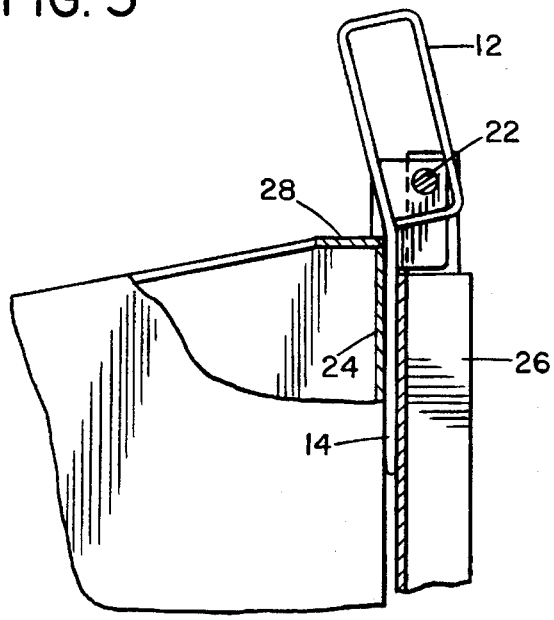
FIG. 4 is a view similar to FIG. 2, showing the lid prop in another position.

The prop can be raised generally in the direction of the arrow shown in FIG. 2 to disengage frame members 10 and 12 from rear wall 24. Momentarily swinging lid 26 to a position in which its weight does not bear against arm 14 may facilitate this action. When the prop has been raised sufficiently that the ends of frame members 10 and 12 clear the rim 28 of trash bin 20, lid 26 is no longer prevented from swinging further open. Lid 26 may thus be swung open to the position shown in FIG. 4, in which lid 26 bears against frame members 10 and 12, and arm 14 bears against rear wall 24. Alternatively, the prop can be raised slightly from the position shown in FIG. 2 to a position (not shown) in which frame 14 does not support any portion of lid 26, which hangs downwardly from hinge rod 22.

Figure 5:
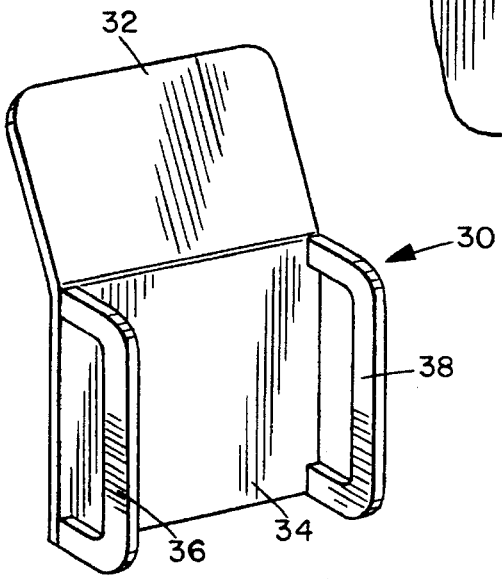
FIG. 5 is a perspective view of another embodiment of the trash bin lid prop.

As illustrated in FIG. 5, an alternative prop comprises a frame 30 and a generally planar first arm 32. Frame 30 comprises a generally planar second arm 34 and two elongated generally rectangular frame members 36 and 38. The openings in frame members 36 and 38 together define a slot-like passage for receiving lid hinge 22.

As those skilled in the art will readily appreciate, the alternative prop illustrated in FIG. 5 may be used in a manner essentially identical to that described above with respect to the embodiment illustrated in FIGS. 1–4. The function of arm 32 corresponds to the function of arm 14 in the embodiment described above. Similarly, the function of frame member 30 corresponds to the combined function of frame members 10 and 12 in the embodiment described above.

Figure 6:
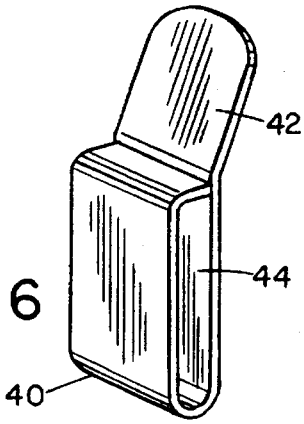
FIG. 6 is a perspective view of still another embodiment of the trash bin lid prop.

As illustrated in FIG. 6, another alternative prop comprises an elongated tubular rectangular frame 40 and an arm 42. Frame 40 has a slot-like passage 44 for receiving lid hinge 22.

As those skilled in the art will readily appreciate, the alternative prop illustrated in FIG. 6 may be used in a manner essentially identical to that described above with respect to the embodiment illustrated in FIGS. 1–4. The function of arm 42 corresponds to the function of arm 14. Similarly, the function of frame member 40 corresponds to the combined function of frame members 10 and 12.

Obviously, other embodiments and modifications of the present invention will occur readily to those of ordinary skill in the art in view of these teachings. Therefore, this invention is to be limited only by the following claims, which include all such other embodiments and modifications when viewed in conjunction with the above specification and accompanying drawings.

What is claimed is:

1. An apparatus on a container for propping a lid of the container in a partially open position, comprising:

a first arm extending away from an axis in a first direction, said first direction having at least a first direction component perpendicular to said axis;

a frame including a second arm connected to said first arm and extending away from said axis in a second direction, said second direction having at least a second direction component perpendicular to said axis, said frame having an elongated slot rotatably retaining a lid rod of said container parallel to said axis, said lid rod axially movable in said elongated slot, one of said first and second arms in contact with said lid and the other of said first and second arms in contact with a rear wall of said container when said lid is in said partially open position, one of said first and second arms movable out of one of said contact when said frame is moved laterally with respect to said lid rod.

2. The apparatus claimed in claim 1, wherein said first and second direction components are separated by an angle between about 10 and 60 degrees.

3. The apparatus claimed in claim 1, wherein said frame comprises two elongated rectangular members having elongated rectangular openings, and said elongated rectangular members are spaced from one another in the direction of said axis.

4. The apparatus claimed in claim 3, wherein said second arm is integrally formed in one piece with said frame.

5. The apparatus claimed in claim 4, wherein said first arm comprises a "U"-shaped member, and each end of the "U" is connected to one of said elongated rectangular members.

6. The apparatus claimed in claim 4, wherein said first and second arms each comprise a planar member.

7. The apparatus claimed in claim 6, wherein said frame comprises two elongated rectangular members having elongated rectangular openings, said elongated rectangular members are spaced from one another in the direction of said axis, and said elongated rectangular members are connected to said second arm.

8. The apparatus claimed in claim 6, wherein said frame comprises a tubular member having a hollow interior and an elongated rectangular cross-section, and said elongated slot is said hollow interior.

9. A method for propping a container lid in a partially open position, comprising the steps of:

disposing a prop on said container, said prop having an elongated slot receiving a lid rod of said container therethrough and rotatably retaining said lid rod along an axis, said lid rod being movable axially in said elongated slot, said prop having a first arm extending away from said axis in a first direction and a second arm extending away from said axis in a second direction, said first direction having a first component perpendicular to said axis, said second direction having a second component perpendicular to said axis; and opening said lid until said lid is in contact with one of said first and second arms and the other of said first and second arms is in contact with a rear wall of said container.

10. The method for propping a container lid in a partially open position claimed in claim 9, further comprising the step of moving said prop generally axially with respect to said lid rod, said lid rod moving generally axially in said slot, until said contact of one of said first and second arms is eliminated.

* * * * *